US009271626B2

(12) United States Patent
Dalton et al.

(10) Patent No.: US 9,271,626 B2
(45) Date of Patent: Mar. 1, 2016

(54) STEAM ACTIVATION OR DEACTIVATION OF CHEMISTRY IN AN APPLIANCE

(75) Inventors: Michael T. Dalton, Saint Joseph, MI (US); Karl D. McAllister, Stevensville, MI (US); Robert J. Rolek, Saint Joseph, MI (US); Sathish Andrea Sundaram, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1451 days.

(21) Appl. No.: 12/331,466

(22) Filed: Dec. 10, 2008

(65) Prior Publication Data

US 2010/0139699 A1 Jun. 10, 2010

(51) Int. Cl.

| | |
|---|---|
| ***B08B 7/00*** | (2006.01) |
| ***A47L 15/00*** | (2006.01) |
| ***D06F 35/00*** | (2006.01) |

(52) U.S. Cl.

CPC ..... *A47L 15/0002* (2013.01); *D06F 35/005* (2013.01); *A47L 2601/04* (2013.01); *D06F 2204/02* (2013.01); *D06F 2204/04* (2013.01)

(58) Field of Classification Search

CPC ..... A47L 15/0002; A47L 2601/04; D06F 35/005; D06F 2204/04; D06F 2204/02

USPC .... 8/158; 134/25.2, 26, 30, 56 D, 57 D, 58 D

See application file for complete search history.

(56) References Cited

U.S. PATENT DOCUMENTS

| | | | | |
|---|---|---|---|---|
| 3,402,576 | A * | 9/1968 | Krupsky | 68/4 |
| 5,272,893 | A | 12/1993 | Anastase et al. | |
| 5,314,636 | A * | 5/1994 | Rek et al. | 510/371 |
| 2002/0137648 | A1 * | 9/2002 | Sharma et al. | 510/218 |
| 2005/0255126 | A1 * | 11/2005 | Tsubaki et al. | 424/195.16 |
| 2006/0151005 | A1 * | 7/2006 | Kim et al. | 134/22.1 |
| 2007/0102026 | A1 * | 5/2007 | Ahn et al. | 134/25.2 |
| 2007/0151129 | A1 | 7/2007 | McAllister et al. | |
| 2007/0157329 | A1 * | 7/2007 | Callen et al. | 800/18 |
| 2007/0256252 | A1 | 11/2007 | Casella et al. | |

FOREIGN PATENT DOCUMENTS

| | | | |
|---|---|---|---|
| DE | 3632056 | A1 | 4/1987 |
| EP | 1657342 | A1 | 5/2006 |
| EP | 1661503 | A2 | 5/2006 |
| EP | 2009166 | A1 | 12/2008 |
| EP | 2141280 | A1 | 1/2010 |
| WO | 2006104310 | A1 | 10/2006 |
| WO | 2008030051 | A2 | 3/2008 |

OTHER PUBLICATIONS

German Search Report for DE102009033893, Feb. 28, 2012.

* cited by examiner

*Primary Examiner* — Michael Barr
*Assistant Examiner* — Benjamin L Osterhout

(57) ABSTRACT

A method for treating a consumer article wherein a treating chemistry is activated or deactivated by the introduction of steam.

10 Claims, 5 Drawing Sheets

STEAM ACTIVATION OR DEACTIVATION OF CHEMISTRY IN AN APPLIANCE

BACKGROUND OF THE INVENTION

Conventional automatic cleaning appliances, such as washing machines, dishwashers, and dryers, for example, typically operate on a consumer article using one or more cycles of operation. The cleaning appliances may often treat the consumer article using a resource such as a treating chemistry. Typically, the cleaning appliance will dispense the treating chemistry into a sump or other mixing area of the appliance, where the chemistry is mixed with water and then applied onto the consumer article.

SUMMARY OF THE INVENTION

The invention relates to a method for treating a consumer article wherein a treating chemistry is activated or deactivated by the introduction of steam.

DESCRIPTION OF AN EMBODIMENT OF THE INVENTION

There are many different types of treating chemistries, e.g. water, detergents, bleach, enzymes, anti-spotting agents, aroma agents, etc. Some of these treating chemistries are deleterious to another chemistry's efficacy. An example is bleach, which is known to destroy certain enzymes found in detergents. Further, some of these treating chemistries may have a short useful duration and may lose their effectiveness before coming into contact with the consumer article. The embodiment of the invention described below solves these problems by controlling the activation/deactivation of the chemistry by controlling the temperature of the chemistries.

Figure 1:
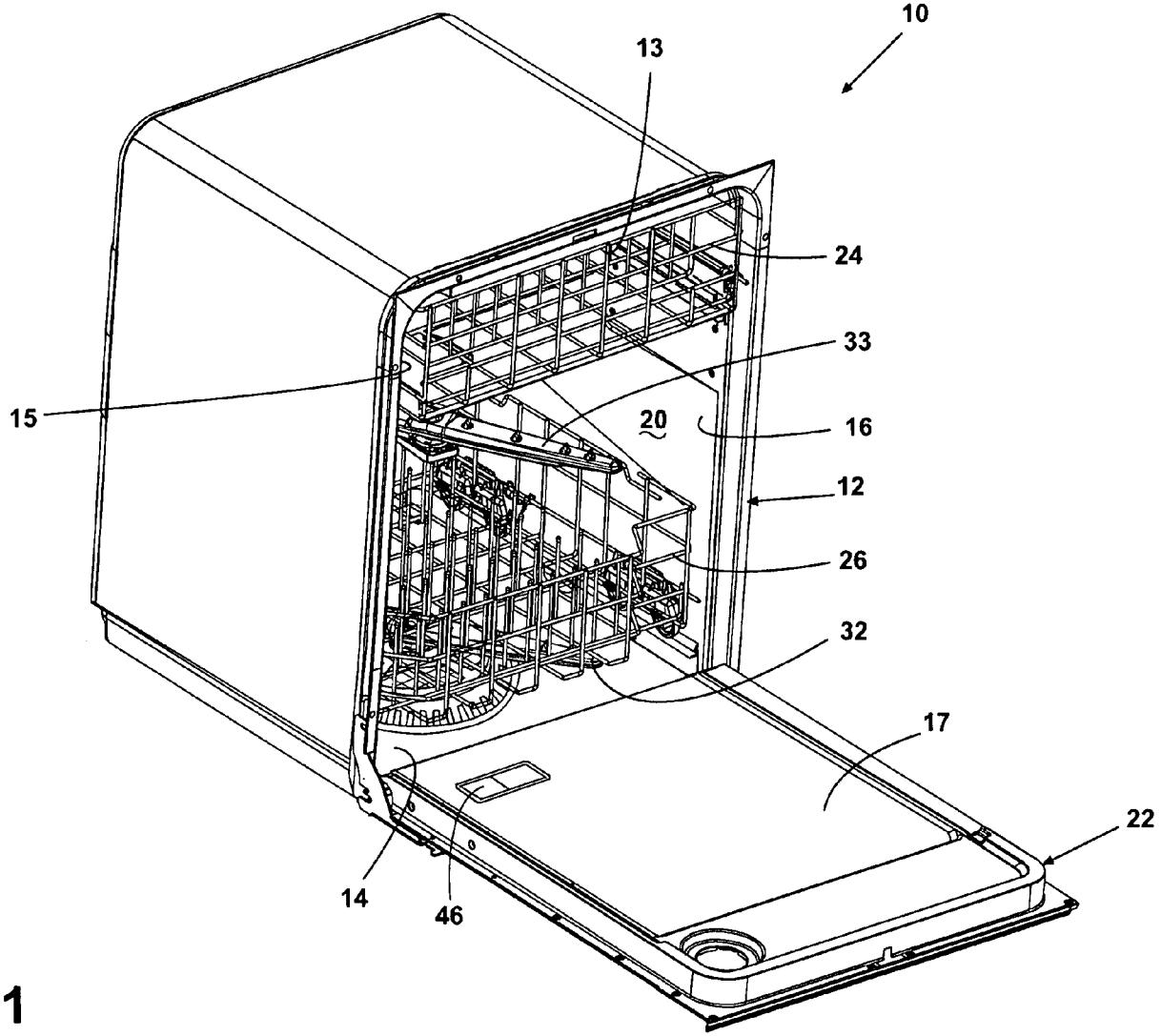
FIG. 1 is a perspective view of a dishwasher according to one embodiment of the invention.

Referring to FIG. 1, a first embodiment of the invention may be illustrated as a cleaning appliance in the environment of a dishwasher 10. Although much of the remainder of this application will focus on the embodiment of a dishwasher 10, the invention may have utility in other environments, including other cleaning appliances, especially in automatic clothes washing machines and dryers. The dishwasher 10 shares many features of a conventional automated dishwasher, which will not be described in detail herein except as necessary for a complete understanding of the invention.

The dishwasher 10 includes an housing 12 having a top wall 13, bottom wall 14, two side walls 15,16, a front wall 17, and a rear wall 18. The walls 13, 14, 15, and 16 collectively define a treating chamber 20. The front wall 17 may be a door 22 of the dishwasher 10, which is moveable to provide access to and to selectively close the treating chamber 20 for loading and unloading consumer articles such as utensils or other washable items. While the present invention is described in terms of a conventional dishwashing unit, it could also be implemented in other types of dishwashing units, such as in-sink dishwashers or drawer-type dishwashers.

Figure 2:
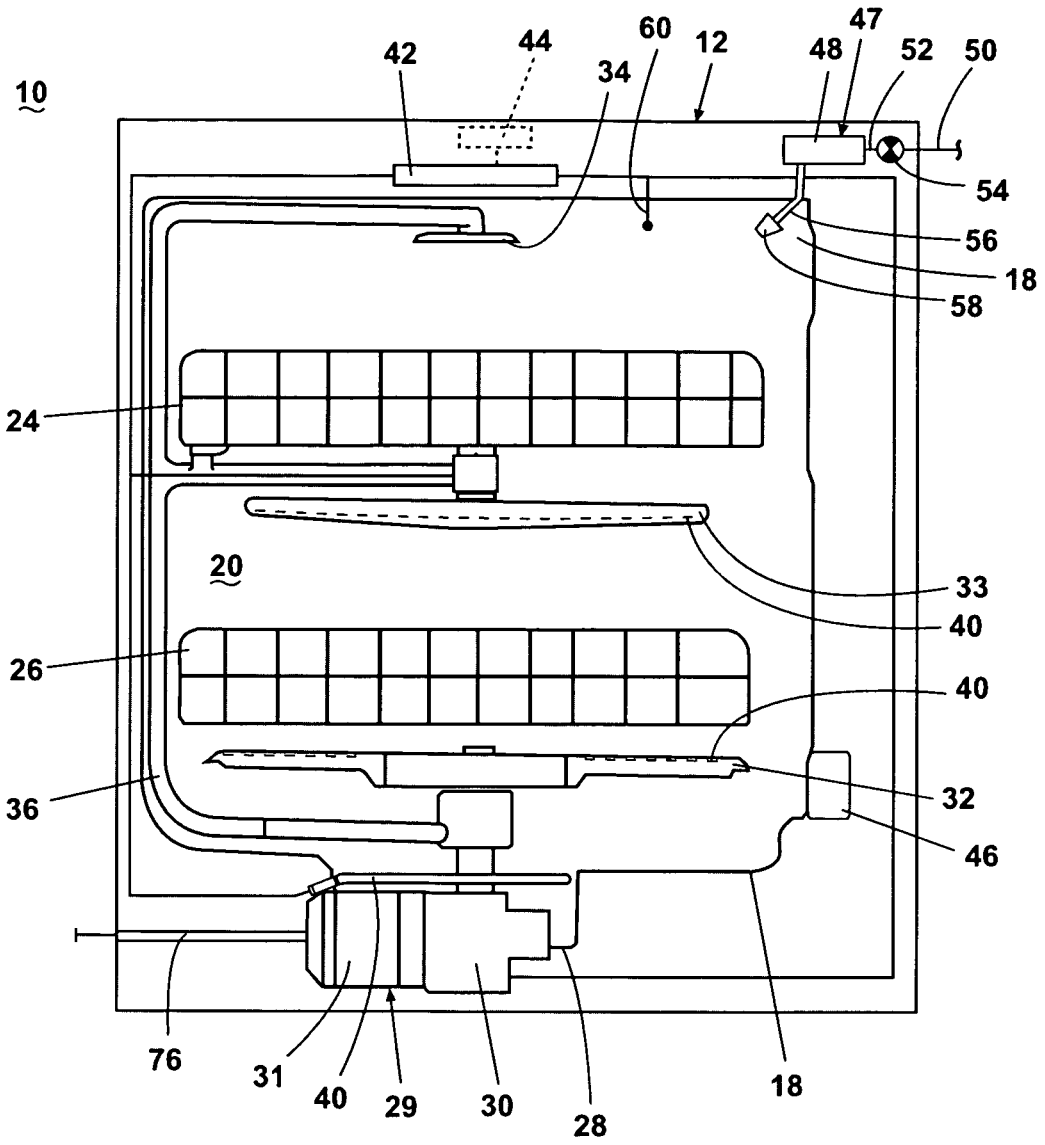
FIG. 2 is a front schematic view of the dishwasher of FIG. 1.

Referring to FIG. 2, utensil holders in the form of upper and lower racks 24, 26 are located within the treating chamber 20 and receive utensils for washing. The upper and lower racks 24, 26 are typically mounted for slidable movement in and out of the treating chamber 20 for ease of loading and unloading. As used in this description, the term utensil is generic to consumer articles such as dishes and the like that are washed in the dishwasher 10 and expressly includes, dishes, plates, bowls, silverware, glassware, stemware, pots, pans, and the like.

The bottom wall 14 of the dishwasher 10 may be sloped to define a lower tub region or sump 28. A pump assembly 29 may be located in or around a portion of the bottom wall 14 and in fluid communication with the sump 28 to draw treating liquid from the sump 28 and to pump the liquid to at least a rotating lower spray arm assembly 32. A heater 40 is located within the sump 28 for heating the liquid contained in the sump 28.

If the dishwasher 10 has a mid-level spray arm assembly 33 and/or an upper spray arm assembly 34, liquid may be selectively pumped through a supply tube 36 to each of the assemblies 32-34 for selective treating. In this way, the pump assembly 29 can draw treating liquid collecting in the sump 28 and distribute it through the sprayers 32-34 into the treating chamber 20, where it naturally flows back to the sump 28 for recirculation or draining as the case may be. The pump assembly 29 may have both a recirculation pump 30 and a drain pump 31.

In this embodiment, the rotating lower spray arm assembly 32 is positioned beneath a lower utensil rack 26, the mid-level spray arm assembly 33 is positioned between an upper utensil rack 24 and the lower utensil rack 26, and the upper spray arm assembly 34 is positioned above the upper utensil rack 24. The rotating lower spray arm assembly 32 is configured to rotate in the treating chamber 20 and spray a flow of treating liquid from at least one outlet 38, in a generally upward direction, over a portion of the interior of the treating chamber 20. The spray from the rotating lower spray arm assembly 32 is typically directed to treat utensils located in the lower rack 26. Like the rotating lower spray arm assembly 32, the mid-level spray arm assembly 33 may also be configured to rotate in the dishwasher 10 and spray a flow of treating liquid from at least one outlet 38, in a generally upward direction, over a portion of the interior of the treating chamber 20. In this case, the spray from the mid-level spray arm assembly 33 is directed to utensils in the upper utensil rack 24. Referring again to FIG. 1, in contrast, the upper spray arm assembly 34 generally directs a spray of treating liquid in a generally downward direction and helps treat utensils on both utensil racks 24, 26.

The pump assembly 29, spray arm assemblies 32-34 and supply tube 36 collectively form a liquid recirculation system for spraying liquid within the treating chamber 20. The pump assembly 29 draws liquid from the sump 28 and delivers it to one or more of the spray arm assemblies 32-34 through the supply tube 36, where the liquid is sprayed back into the treating chamber 20 through the spray arm assemblies 32-34 and drains back to the sump 28 where the process is repeated. While the spray arm assemblies 32 and 33 are illustrated as rotating spray arms and upper spray arm assembly 34 is illustrated as a fixed spray head, the spray arm assemblies can be of any structure and configuration. The dishwasher 10 may further include other conventional components such as additional spray arms or nozzles, a filter, etc.; however, these components are not germane to the present invention and will not be described further herein.

A controller 42 is operably coupled to the pump assembly 29, heater 40, and various components of the dishwasher 10 to implement a cleaning cycle. The dishwasher 10 may be pre-programmed with a number of different cleaning cycles from which a user may select one cleaning cycle to clean a load of utensils. Non-limiting examples of cleaning cycles include normal, light/china, heavy/pots and pans, and rinse only. A control panel or user interface 44 provided on the dishwasher 10 and coupled to the controller 42 may be used to select a cleaning cycle. The user interface 44 can be provided on the outer panel of the door 22 and can include operational controls such as dials, lights, switches, and displays enabling a user to input commands to the controller 42 and receive information about the selected cleaning cycle. Alternately, the cleaning cycle may be automatically selected by the controller 42 based on soil levels sensed by the dishwasher 10 to optimize the cleaning performance of the dishwasher 10 for a particular load of utensils.

A dispensing system 46 is provided for dispensing treating chemistries, including water, into the treating chamber 20. The dispensing system 46 may be located anywhere within dishwasher 10 as long as it is positioned to be able to dispense the treating chemistry into the treating chamber 20. It is contemplated that the dispensing system 46 will be carried by the door 22. The type of dispensing system 46 is not germane to the invention. It can be a single dose dispensing system, a multiple dose dispensing system (a bulk dispenser), or a combination of both. The dosage may be constant, variable, user controlled, or automatically controlled. The treating chemistry dispensed from the dispensing system 46 may be mixed with water and applied to the utensils in the treating chamber 20. Water may enter the treating chamber 20 directly through the dispensing system 46 or from another inlet.

A steam generation system 47 is provided for supplying steam to the treating chamber. The steam generation system 47 includes a steam generator 48 that receives liquid from a water supply 50 through a supply conduit 52. An inlet valve 54 controls flow of the water to the steam generator 48. A steam conduit 56 fluidly couples the steam generator 48 to a steam inlet 58, which introduces steam into the treating chamber 20. The steam inlet 58 is shown as being coupled to the top wall 13 of the treating chamber 20. The steam inlet 58 may couple with the treating chamber 20 at any suitable location of the treating chamber 20. The steam inlet 58 may introduce the steam into the treating chamber 20 in any suitable manner.

The steam generator 48 may be any type of device that converts the liquid to steam. For example, the steam generator 48 can be a tank-type steam generator that stores a volume of liquid and heats the volume of liquid to convert the liquid to steam. Alternatively, the steam generator 48 can be an in-line steam generator that converts the liquid to steam as the liquid flows through the steam generator 48. The steam generator 48 can produce pressurized or non-pressurized steam.

A temperature sensor 60 may also be provided within the dishwasher 10 for sensing the temperature inside the treating chamber 20. The temperature sensor 60 may sense the ambient temperature of the air within the cavity, which in such a case the temperature sensor may be a thermister. The temperature sensor 60 may also sense the temperature of the utensils within the treating chamber 20, which in such a case it may be a laser or a thermal imaging device. The temperature sensor 60 may comprises multiple types of sensors to sense the temperature of different areas in the treating chamber 20 or different utensils within the treating chamber 20. The temperature sensor may be used to sense the temperature of the steam from the steam generator.

The temperature sensor 60 is illustrated being coupled to the controller 42, which receives the output from the temperature sensor 60. The output may represent the sensed temperature or may need to be processed by the controller 42 to determine the sensed temperature.

The controller 42 may utilize the temperature obtained from the output to control the operation of the dishwasher 10 or individual components of the dishwasher 10. The controller 42 may be configured to convert the determined temperature of the treating chamber 20 to the temperature of the utensils or the temperature of the treating chemistry and control the operation of the dishwasher 10 based on the temperature of the utensils or the temperature of the treating chemistry. Alternatively, the controller 42 may be configured to control the operation of the dishwasher 10 without converting the determined temperature to the temperature of the utensils or the temperature of the treating chemistry. The controller 42 may control the dishwasher 10 in any suitable manner. For example, the controller 42 can control the operation of the steam generator 48 based on the determined temperature. The operation of the steam generator 48 can include, by example, initiating steam generation, stopping steam generation, controlling water flow into the steam generator 48, and controlling a steam generation rate, such as by controlling a heater of the steam generator 48.

The liquid supply and recirculation system and the steam generator system may differ from the configuration shown in FIG. 1, such as by inclusion of other valves, conduits, treating chemistry dispensers, and the like, to control the flow of liquid and steam through the dishwasher 10 and for the introduction of more than one type of treating chemistry.

The previously described dishwasher 10 provides the structure necessary for the implementation of a method of the invention. Several embodiments of the method will now be described in terms of the operation of the dishwasher 10. The embodiments of the method function to activate and/or deactivate the treating chemistry dispensed into the treating chamber 20 using the steam generator 48. Depending on whether the treating chemistry needs to be activated or deactivated, a cycle of operation of the dishwasher 10 may be automatically adapted for optimum treating performance. This may include setting various parameters of cycle of operation, such as the treating time, temperature to which the treating chamber 20 is heated, type of chemistry dispensed, or amount of the chemistry dispensed, or any combination thereof.

Figure 3:
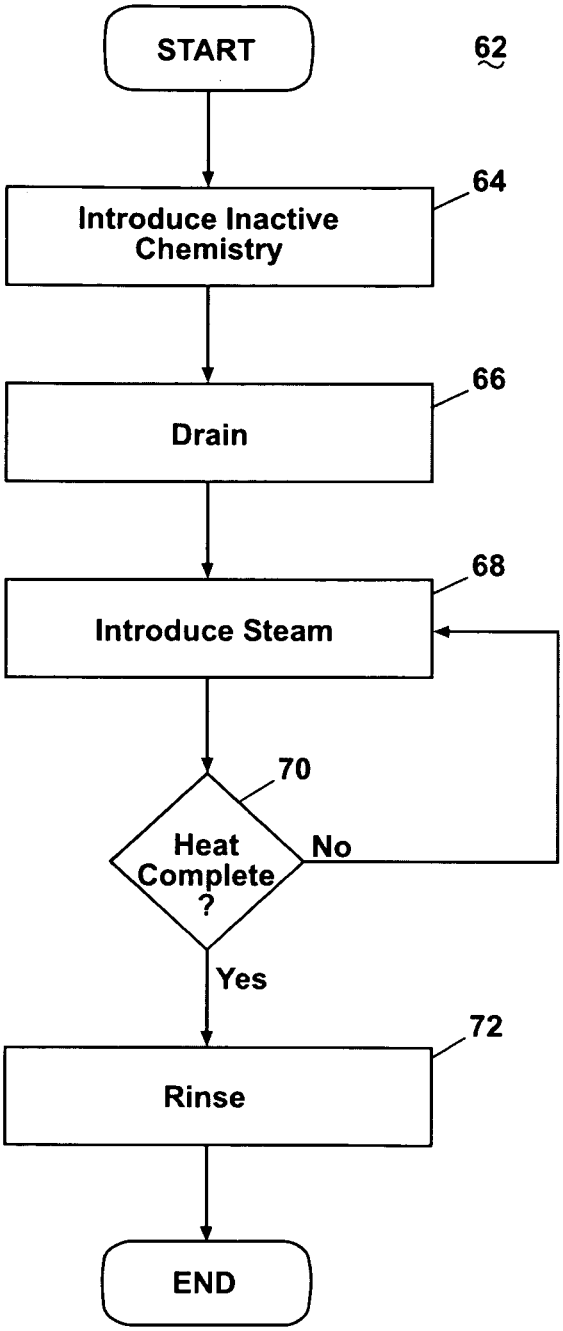
FIG. 3 is a flow chart of a method of treating a consumer article according to one embodiment of the invention.

An activation method 62 of operating the dishwasher 10 to activate a treating chemistry with steam according to one embodiment of the invention is illustrated in FIG. 3. Before the introduction step 64 begins, a user may add an inactive treating chemistry to the dishwasher 10. The user may place the inactive treating chemistry such as a detergent or enzyme in the dispensing system 46 or directly into the treating chamber 20.

The activation method 62 begins with the utensils subjected to a treating chemistry having an activation temperature during the introduction step 64. The introduction step 64 can also be considered a wetting step whereby the utensils are wetted with the inactive treating chemistry or inactive treating chemistry solution. According to one embodiment of the invention, the utensils can be soaked with the inactive treating chemistry or inactive treating chemistry solution. Any inactive treating chemistry or water that does not adhere to the utensils or some part in the interior of the dishwasher 10 flows to the sump 28. The pump assembly 29 pumps the liquid from the sump 28 through the supply tube 36 to the spray arm assemblies 32-34 and through the at least one outlet 38 to recirculate the liquid from the sump 28 to the utensils located in the interior of the treating chamber 20, thereby wetting the utensils with the liquid. The manner in which the utensils are subjected to the inactive treating chemistry is not germane to the invention. It is contemplated that the inactive treating chemistry will be applied to the utensils through the recirculation system after the treating chemistry has been dispensed from the dispensing system. Alternatively, the inactive treating chemistry may be dispensed directly onto the utensils, without first being mixed with water or the inactive treating chemistry may be mixed with a lesser amount of water, by any suitable mechanical or hydraulic means.

An amount of liquid may be drained during an optional drain step 66. Draining may be desired because the treating chemistry may be more effectively, efficiently, and expeditiously heated with less extraneous liquid in the treating chamber 20. With extraneous liquid in the treating chamber 20, there is an increase in the time and amount of energy needed to heat the treating chemistry. Thus, the liquid in the sump 28 may be drained during a drain step 66. The liquid may be drained from the sump 28 through a drain pump 31 (FIG. 2) and a drain conduit 76 (FIG. 2) to a waste line (not shown) within the home. The less water there is in the sump 28 the less energy that is required to heat the treating chamber 20 to the treating chemistries activation temperature.

After the drain step 66, a heat step 68 heats the utensils and the inactive treating chemistry or inactive treating chemistry solution adhered to the utensils relatively quickly due to the relatively small amount of liquid. During the heat step 68 steam may be introduced into the treating chamber to raise the temperature of the treating chemistry to an activation temperature. To introduce steam, liquid enters the supply conduit 52 through the inlet valve 54 from the water supply 50. The steam generator 48 converts the liquid to steam, which flows through the steam conduit 56 to the steam inlet 58, where the steam enters the treating chamber 20. The steam disperses from the steam inlet 58 and heats the utensil load and the treating chemistry or treating chemistry solution adhered to the utensil load. The steam may also heat any liquid present in the treating chamber 20 or other component of the liquid supply and recirculation system. The steam may also heat the air inside the treating chamber 20 and any other part in the treating chamber 20.

The purpose of the heat step 68 is to raise the temperature of the inactive treating chemistry to its activation temperature with the introduction of steam. To raise the temperature of the treating chemistry to the activation temperature the treating chamber 20 may be heated to the activation temperature or higher. Thus, the introduction of steam may be for a period until the air temperature of the treating chamber 20 is raised to the activation temperature of the treating chemistry. The temperature of the treating chamber 20 may be determined in any suitable manner. For example, the temperature of the treating chamber 20 may be determined with a temperature sensor 60 positioned in the treating chamber 20. Alternatively, the introduction of steam may be for a period until the actual treating chemistry is raised to the activation temperature of the treating chemistry. Raising the temperature of the treating chemistry to the activation temperature may be accomplished before the utensil reaches the activation temperature. Alternatively, introducing the steam may raise the temperature of the utensil to at least the activation temperature of the treating chemistry. The steam may be introduced continuously or according to a duty cycle. Steam may be added for a duration that is sufficient to ensure that all of the treating chemistry remaining in the treating chamber has been activated. It should be understood that the activation temperature may not be a specific temperature but a range over which chemical activity increases, thereby rendering the distributed chemistry more effective. In that case, steam may be introduced so that the temperature of the inactive treating chemistry is raised to any temperature within that range. As an alternative, an activation temperature may be a temperature at which a chemistry is released from an encapsulated state. In that case, steam may be introduced such that the temperature of the encapsulated chemistry is raised to a temperature where all of the encapsulated chemistry is released.

After the treating chemistry reaches the activation temperature, the steam may be introduced as needed to maintain the activation temperature for a predetermined time. For example, if the treating chemistry has a useful duration, or a period wherein it may perform after activation, the temperature inside the treating chamber may be kept at the activation temperature during the useful duration. Further, the predetermined time may be an empirically determined time and may be a time corresponding to sufficient heating of the utensils on which the treating chemistry resides or a sufficient heating of the entire treating chamber 20.

If it is determined in step 70 that the heat step 68 is not complete, then the heat step 68 continues and the controller 42 checks again to see if the heat step 68 is complete. If it is determined in step 70 that the heat step 68 is complete, then the activation method 62 proceeds to a rinse step 72. During this rinse step 72, the activated active treating chemistry is rinsed off the utensils using a treating liquid comprising water and, optionally, a drying aid. This also serves to mechanically remove the soils that have been chemically loosened or broken down.

While the activation method has been specifically described in the above manner the method may vary. For example, the introduction of steam in the heat step may occur prior to the introduction of the inactive treating chemistry into the treating chamber 20 through an introduction step. This alternative may be used to ensure that the temperature inside the treating chamber 20 is at the activation temperature of the treating chemistry from the beginning of its useful duration. The introduced treating chemistry may be mixed with the introduced steam prior to the treating chemistry contacting the utensil. Thus, the heating of the treating chemistry to the activation temperature may be accomplished prior to the introduced treating chemistry contacting the utensil. Further, a wash step may occur after it is determined in step 70 that the heat step 68 is complete. This wash step may last for a predetermined period to allow the now activated chemistry to continue to work. Further, additional water may be added and recirculated throughout the tub and utensils to provide mechanical energy to remove soils.

Figure 4:
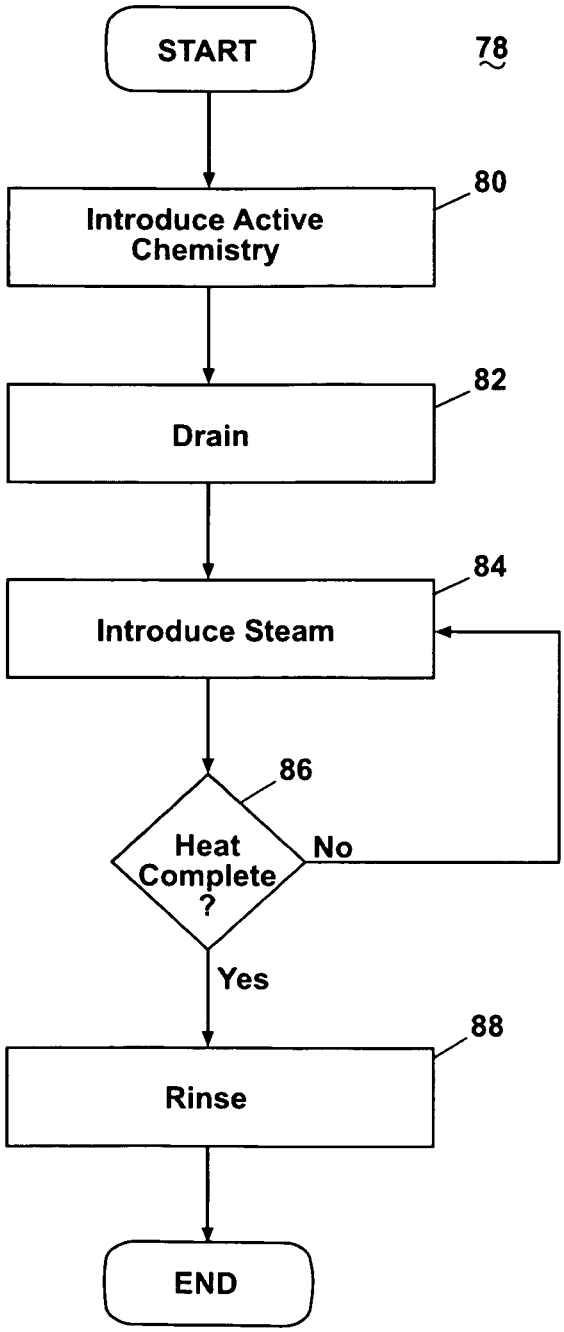
FIG. 4 is a flow chart of a method of treating a consumer article according to another embodiment of the invention.

A deactivation method 78 of operating the dishwasher 10 to deactivate a treating chemistry with steam according to one embodiment of the invention is illustrated in FIG. 4. Before an introduction step 80 begins, a user may add an active treating chemistry to the dishwasher 10. The user may place the active treating chemistry such as a detergent or enzyme in the dispensing system 46 or directly into the treating chamber 20.

The deactivation method 78 beings with the utensils subjected to an active treating chemistry having a deactivation temperature during the introduction step 80. During the introduction step 80, an active treating chemistry either by itself or in a solution with water flows through the liquid supply and recirculation system comprised of the pump assembly 29 and spray arm assemblies 32-34. The appropriate spray arms 32-34 are used to facilitate distribution of the active treating chemistry or active treating chemistry solution to the utensils.

The introduction step 80 can also be considered a wetting step whereby the utensils are wetted with the active treating chemistry or active treating chemistry solution. According to one embodiment of the invention, the utensils can be soaked with the active treating chemistry or active treating chemistry solution. Any active treating chemistry or water that does not adhere to the utensils or some part in the interior of the dishwasher 10 flows to the sump 28. The pump assembly 29 pumps the liquid from the sump 28 through the supply tube 36 to the spray arm assemblies 32-34 and through the at least one outlet 38 to recirculate the liquid from the sump 28 to the utensils located in the interior of the treating chamber 20, thereby wetting the utensils with the liquid. The manner in which the utensils are subjected to the active treating chemistry is not germane to the invention. It is contemplated that the active treating chemistry will be applied to the utensils through the recirculation system after the treating chemistry has been dispensed from the dispensing system. Alternatively, the active treating chemistry may be dispensed directly onto the utensils, without first being mixed with water or the active treating chemistry may be mixed with a lesser amount of water, by any suitable mechanical or hydraulic means. As another alternative, prior steps may have occurred to the introduction step 80 where a user introduced an inactive chemistry to the dishwasher 10 and such chemistry was activated.

An optional soaking period (not shown) may be included wherein the active treating chemistry is allowed to work on the soil on the utensils. This soaking period may be for the useful duration of the treating chemistry or any duration less than a duration where the treating chemistry becomes deleterious to the efficacy of the treating.

After any soaking period, an optional drain step 82 may occur. Draining may be desired because the treating chemistry may be more effectively, efficiently, and expeditiously heated without the presence of extraneous liquid. With extraneous liquid in the treating chamber 20, additional heat is required to heat the extraneous liquid along with the treating chemistry. Thus, the liquid in the sump 28 may be drained during a drain step 82. The liquid may be drained from the sump 28 through a drain pump 31 (FIG. 2) and a drain conduit 76 (FIG. 2) to a waste line (not shown) within the home. The less water there is in the sump 28 the less energy that is required to heat the treating chamber 20 to the treating chemistries deactivation temperature.

The treating chemistry remaining on the utensils may be deactivated during a heat step 84. During the heat step 84 steam may be introduced into the treating chamber to raise the temperature of the treating chemistry to a deactivation temperature. To introduce steam, liquid enters the supply conduit 52 through the inlet valve 54 from the water supply 50. The steam generator 48 converts the liquid to steam, which flows through the steam conduit 56 to the steam inlet 58, where the steam enters the treating chamber 20. The steam disperses from the steam inlet 68 and heats the utensil load and the treating chemistry or treating chemistry solution adhered to the utensil load. The steam may also heat any liquid present in the treating chamber 20 or other component of the liquid supply and recirculation system. The steam may also heat the air inside the treating chamber 20 and any other part in an interior of the treating chamber 20.

The purpose of the heat step 84 is to raise the temperature of the active treating chemistry to its deactivation temperature by the introduction of steam. To raise the temperature of the treating chemistry to the deactivation temperature the treating chamber 20 may be heated to the deactivation temperature or higher. Thus, the introduction of steam may be for a period until the air temperature of the treating chamber 20 is raised to the deactivation temperature of the treating chemistry. The temperature of the treating chamber 20 may be determined in any suitable manner. For example, the temperature of the treating chamber 20 may be determined with a temperature sensor 60 positioned in the treating chamber 20. Alternatively, the introduction of steam may be for a period until the actual treating chemistry is raised to the deactivation temperature of the treating chemistry. Raising the temperature of the treating chemistry to the deactivation temperature may be accomplished before the utensil reaches the deactivation temperature. Alternatively, introducing the steam may raise the temperature of the utensil to at least the deactivation temperature of the treating chemistry. The steam may be introduced continuously or according to a duty cycle. Steam may be added for a duration that is sufficient to ensure that all of the treating chemistry remaining in the treating chamber has been deactivated. As an alternative, a deactivation temperature may be a temperature at which a chemistry is released from an encapsulated state that in turn deactivates the active chemistry. In that case, steam may be introduced such that the temperature of the encapsulated chemistry is raised to a temperature where all of the encapsulated chemistry is released and deactivated.

After the treating chemistry reaches the deactivation temperature, the steam may be introduced as needed to maintain the deactivation temperature for a predetermined time. The predetermined time may be an empirically determined time and may be a time corresponding to sufficient heating of the utensils on which the treating chemistry resides or a sufficient heating of the entire treating chamber 20. The predetermined time may also be the time necessary to make sure that all off the active treating chemistry has been deactivated. This may be important if the active chemistry may be corrosive to conduits inside the dishwasher 10 or conduits in the home or sewer system. If the active treating chemistry after a duration becomes deleterious to the efficacy of the treating of the consumer article or becomes deleterious to the dishwasher or home, the temperature inside the treating chamber should be raised to the deactivation temperature before the end of that duration.

If it is determined in step 86 that the heating step 84 is not complete, then the heating step 84 continues and the controller 42 checks again to see if the heating step 84 is complete. If it is determined in step 86 that the heating step 84 is complete, then the deactivation method 78 proceeds to a rinse step 88. During this rinse step 88, the deactivated treating chemistry is rinsed off the utensils using a treating liquid comprising water and, optionally, a drying aid. This also serves to mechanically remove the soils that have been chemically loosened or broken down.

While the deactivation method has been specifically described in the above manner the method may vary. For example, the introduction of steam in the heat step may occur prior to the introduction of the active treating chemistry into the treating chamber 20 through an introduction step. This alternative may be used to ensure that the temperature inside the treating chamber 20 may more quickly reach the deactivation temperature if the active chemistry has a short useful duration or will quickly become deleterious to the efficacy of the treating.

Depending upon the treating chemistry used the method for treating a consumer article may also vary. For example, the duration of the heat step may vary. The duration of the introduction step may vary. Furthermore, an inactive treating chemistry may be activated by the introduction of steam in a first heat step and then the same treating chemistry may be deactivated by the introduction of steam in a second heat step before the end of the operating cycle.

As described above, one approach of reducing energy consumption has been to use steam rather than recirculated water to heat the treating chamber 20. Heating the treating chamber 20 by recirculating heated water requires that a larger volume of water, specifically the amount of water required to satisfy the hydraulic system, be heated to the activation or deactivation temperature of the chemistry. This results in a relatively large power consumption by the dishwasher 10. Whereas heating with steam requires less energy because only the utensils, racks, and the amount of water sufficient to transfer such heat in the form of steam are heated. In addition, steam will reach areas of the dishwasher 10 that may not be reliably reached by water sprayed by the spray arm assemblies 32-34.

The dishwasher 10 with the steam generator 48 may use less water to heat the treating chamber 20 than a dishwasher that uses only an immersion heater. Steam may be injected into the sump of the dishwasher 10 or directly into the treating chamber to heat the treating chamber 20. Whether during the activation or deactivation of a treating chemistry, the raising of temperature of the treating chemistry comprises transferring heat from molecules of the introduced steam to molecules of the introduced treating chemistry. When a molecule of water vapor comes into contact with the utensil load or treating chemistry on the utensil load, which is at a much lower temperature, the vapor will condense to a liquid, giving-up its latent heat of vaporization. Heat transfer using steam occurs much faster than when there is a high temperature gradient in which no phase change occurs.

Figure 5:
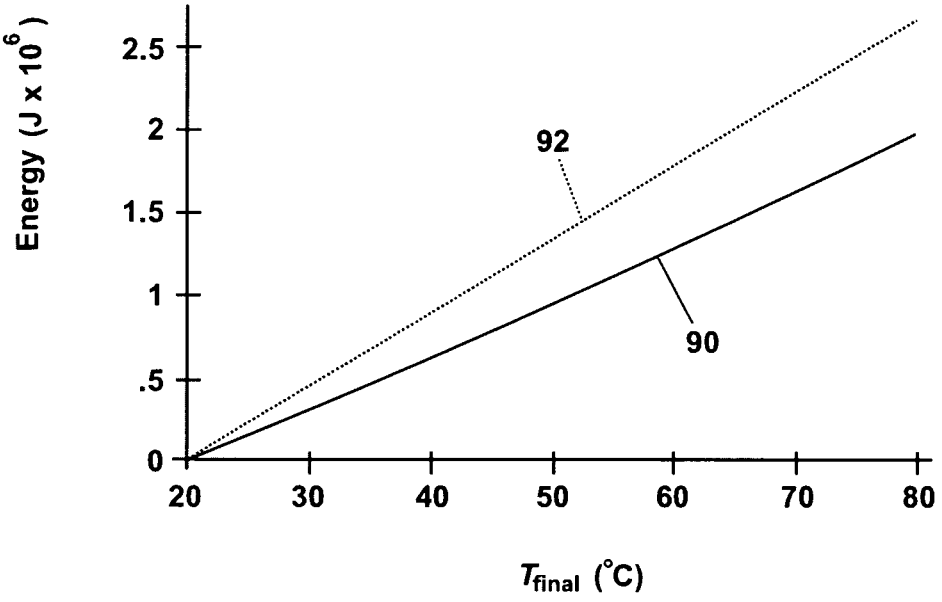
FIG. 5 is a graph of energy as a function of temperature change in a treating chamber for heating using steam and heating using a heater immersed in water.

FIG. 5 shows the power consumed when given a starting system and water temperature of 20° C. steam is used to heat the treating chamber and an immersion heater in water is used to heat the treating chamber to the same temperature. As may easily be seen by comparing the steam energy profile 90 and the water energy profile 92 the power consumed when steam is used to heat is significantly less than the power consumed when an immersion heater in water is used to heat.

As a limited wattage is available for an individual residential appliance, energy savings will also result in time savings. To reach the activation temperature or deactivation of the treating chemistry, the introduction of steam is for a duration less than the duration to raise the temperature of the treating chamber by heating liquid in a sump of the treating chamber with an immersion heater. Not only is the time savings a benefit to the consumer, but a faster elevation of the load temperature may improve the effectiveness of some chemistries. Further, the steam heat may be more even throughout the treating chamber 20. Thus, the use of steam to heat further improves the performance of the dishwasher 10 as all utensils in the dishwasher 10 are contacted by a sufficient temperature for activating or deactivating the treating chemistry and this provides for more effective cleaning.

While the invention has been specifically described in connection with certain specific embodiments thereof, it is to be understood that this is by way of illustration and not of limitation, and the scope of the appended claims should be construed as broadly as the prior art will permit.

It is within the scope of the invention to perform the inventive method on other types of household appliances. For example, another embodiment of the invention may include a washing machine where treating chemistry having an activation or deactivation temperature may be introduced into the treating chamber and steam from a steam generator is introduced into the treating chamber through a steam inlet. Either a drum or a tub of the washing machine may be considered the treating chamber. Steam may enter the tub and be directed to the drum through perforations in the drum. Alternatively, the steam inlet may be configured to introduce the steam directly into the drum.

What is claimed is:

1. A method of treating a utensil in a dishwasher having a tub defining a treating chamber in which is located a rack for holding the utensil during treatment, the method comprising:

supporting the utensil in the rack;

applying a treating chemistry having at least one enzyme having an enzyme deactivation temperature onto the utensil by spraying the treating chemistry into the treating chamber; and introducing steam into the treating chamber to raise the temperature of the treating chemistry on the utensil to the enzyme deactivation temperature.

2. The method of claim 1 wherein the treating chemistry further comprises a detergent.

3. The method of claim 1 wherein the treating chemistry after a duration becomes deleterious to an efficacy of the treating of the utensil and the temperature inside the treating chamber is raised to the enzyme deactivation temperature before an end of that duration.

4. The method of claim 1 wherein the introduction of steam is begun after a beginning of the applying of the treating chemistry.

5. The method of claim 1 wherein the introduction of steam is begun prior to the applying of the treating chemistry.

6. The method of claim 1 wherein the introduction of steam is for a duration less than a duration to raise the temperature of the treating chamber by heating liquid in a sump of the treating chamber with an immersion heater.

7. The method of claim 1 wherein the raising the temperature of the treating chemistry to the enzyme deactivation temperature comprises raising an air temperature of the treating chamber to the enzyme deactivation temperature.

8. The method of claim 1 wherein the raising the temperature of the treating chemistry to the enzyme deactivation temperature is done prior to the utensil reaching the enzyme deactivation temperature.

9. The method of claim 1 wherein the introduction of steam raises the temperature of the utensil to at least the enzyme deactivation temperature of the treating chemistry.

10. The method of claim 1 wherein the raising of temperature of the treating chemistry comprises transferring heat from molecules of the introduced steam to molecules of the introduced treating chemistry.

* * * * *